US005192201A

United States Patent [19]

Beben

[11] Patent Number: 5,192,201

[45] Date of Patent: Mar. 9, 1993

[54] ROTARY ENGINE AND DRIVE COUPLING

[76] Inventor: Jacek Beben, 2426 W. Bobby La., Santa Ana, Calif. 92706

[21] Appl. No.: 597,367

[22] Filed: Oct. 15, 1990

[51] Int. Cl.[5] ..... F01C 1/42

[52] U.S. Cl. ..... 418/38; 418/35; 123/245

[58] Field of Search ..... 418/35, 37, 38; 123/245

[56] References Cited

U.S. PATENT DOCUMENTS

| | | | |
|---|---|---|---|
| 1,330,629 | 2/1920 | Gooding | 418/38 |
| 1,458,950 | 6/1923 | Poirmeur | 418/38 |
| 2,851,998 | 9/1958 | Mallinckrodt | 418/38 |
| 3,299,865 | 1/1967 | Moyer | 418/37 |
| 3,890,939 | 6/1975 | McIntosh | 418/38 |

FOREIGN PATENT DOCUMENTS

| | | | |
|---|---|---|---|
| 491154 | 6/1976 | Australia | 418/38 |

*Primary Examiner*—Richard A. Bertsch
*Assistant Examiner*—David L. Cavanaugh
*Attorney, Agent, or Firm*—Roy A. Ekstrand

[57] ABSTRACT

A rotary engine includes a pair of rotors each supporting opposed toroidal section pistons rotatably disposed within a crank case defining a toroidal combustion chamber. The piston rotors define pluralities of curved slots which receive interconnecting coupling pins. A drive cam cooperates with the drive pins and a slotted pin guide is captivated between the drive cam and one of the slotted piston rotors. The cooperation of the pin guide, cam and slotted rotors provides the required piston motion and power coupling for use as a rotary engine for rotary pump or compressor.

23 Claims, 4 Drawing Sheets

ROTARY ENGINE AND DRIVE COUPLING

FIELD OF THE INVENTION

This invention relates generally to rotary engines and particularly to power couplings used therein.

BACKGROUND OF THE INVENTION

Through the years, an number of internal combustion engines have been conceived which harness the power supplied by the rapid expansion of burning hydrocarbon fuels. These engines have taken several forms. However, to date the most pervasive has been the reciprocating or piston engine. While piston engines have provided substantial power and sophistication, they are subject to an inherent limitation in that the power harnessing pistons travel in a reciprocating manner within a linear combustion chamber. As a result, such engines are subject to substantial wear and limited in their speed of revolution.

An alternate form of internal combustion engine which has not enjoyed the popularity of piston engines is found in the rotary engine. Rotary engines promise a substantial improvement once the difficulties associated therewith have been overcome in that the pistons travel rotationally and therefore are not subjected to the extreme acceleration and deceleration forces of a reciprocating engine. Within a variety of rotary engines which have been conceived, one of the most promising is that found in rotary engines in which pairs of pistons usually situated on opposite sides of a rotating member are mechanically coupled in a manner in which the distance between the oppositely paired piston sets is varied as their relative rotational velocities change. Such engines utilize the changing spacing between piston sets to provide the internal combustion engine functions of intake compression, power and exhaust.

U.S. Pat. No. 3,183,898 issued to Sandone sets forth ROTARY ENGINE in which a pair of rotary members each support a pair of opposed pistons. A surrounding case provides an annular closed volume accessible through intake and exhaust ports and provided with an ignition port. As the rotatable members rotate, slotted grooves within the rotatable members cooperate with captive ball elements in a power take-off shaft to couple power the rotating pistons.

U.S. Pat. No. 1,458,950 issued to Poirmeur set forth an EXPLOSION ROTATING ENGINE which is similar in concept to the Sandone engine described above but which utilizes a plurality of grooves and elongated coupling members having pegs which travel within the slotted grooves. The relative spacing between pistons is controlled by the contours of the grooves.

U.S. Pat. No. 2,851,998 issued to Mallinckrodt sets forth a ROTARY ENGINE in which several rotating systems having alternating pistons interchange angular momentums during certain reverse locking events. Expansion events between the pistons cause the systems to overrun one another and supply power to a shaft through the power integration means.

U.S. Pat. No. 2,092,254 issued to Horner sets forth a ROTARY COMBUSTION ENGINE in which a pair of rotors are rotatably supported within an annular combustion chamber. Each rotatable member supports a quartet of disk-shaped pistons fitted to the annular combustion chamber. The relative distance between the piston sets is used to provide the operative strokes for internal combustion engine operation. A slotted coupling and pin arrangement is used to couple power from the rotating members to the power take-off shaft.

U.S. Pat. No. 3,299,865 issued to Moyer sets forth a ROTARY COMBUSTION ENGINE similar to the above-described rotary engines in which a pair of cam plates carrying cam grooves and axially spaced with respect to the central casting define radial guide slots engaged by cam followers. A power take-off shaft fixed to the rotatable cam plates extends outwardly along the central casting axis.

U.S. Pat. No. 3,890,939 issued to McIntosh sets forth a ROTARY ENGINE WITH IMPROVED SEAL AND TIMING MECHANISM PROVIDING LINEAR ACCELERATION BETWEEN PISTONS DURING THE POWER STROKE in which a mechanism is operative to transfer power from the rotary engine pistons to a drive shaft and also provide for relative movement between pistons according to a predetermined function. The mechanism includes a pair of rotating slotted members cooperating with a plurality of planetary gears moving in an engaging fashion within the interior of an internal gear track. Pins extend from the rotating planetary gears to the slots within the rotating members which are coupled to the pistons.

While the foregoing described prior art devices have improved such rotary engines to some extent, they have as yet failed to provide a simple, direct and reliable mechanism for coupling power within such rotary engines. There remains, therefore, a need in the art for an improved power coupling mechanism for rotary engines.

SUMMARY OF THE INVENTION

Accordingly, it is a general object of the present invention to provide an improved rotary engine. It is a more particular object of the present invention to provide an improved rotary engine having an effective power coupling mechanism for transferring power between the rotating piston elements and a power shaft.

In accordance with the present invention, there is provided rotary engine which comprises: a first piston rotor defining a first plurality of curved slots and a first rotating member and a first plurality of outwardly extending pistons; a second piston rotor defining a second plurality of curved slots and a second rotating member and a second plurality of outwardly extending pistons; a pin guide defining a plurality of radially extending slots; a first shaft coupled to the pin guide; a drive cam defining a cam surface; a second shaft coupled to the cam; and a plurality of pins each partially received within one of the curved slots in each of the first and second piston rotors and one of the slots in the pin guide and each contacting the cam surface.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
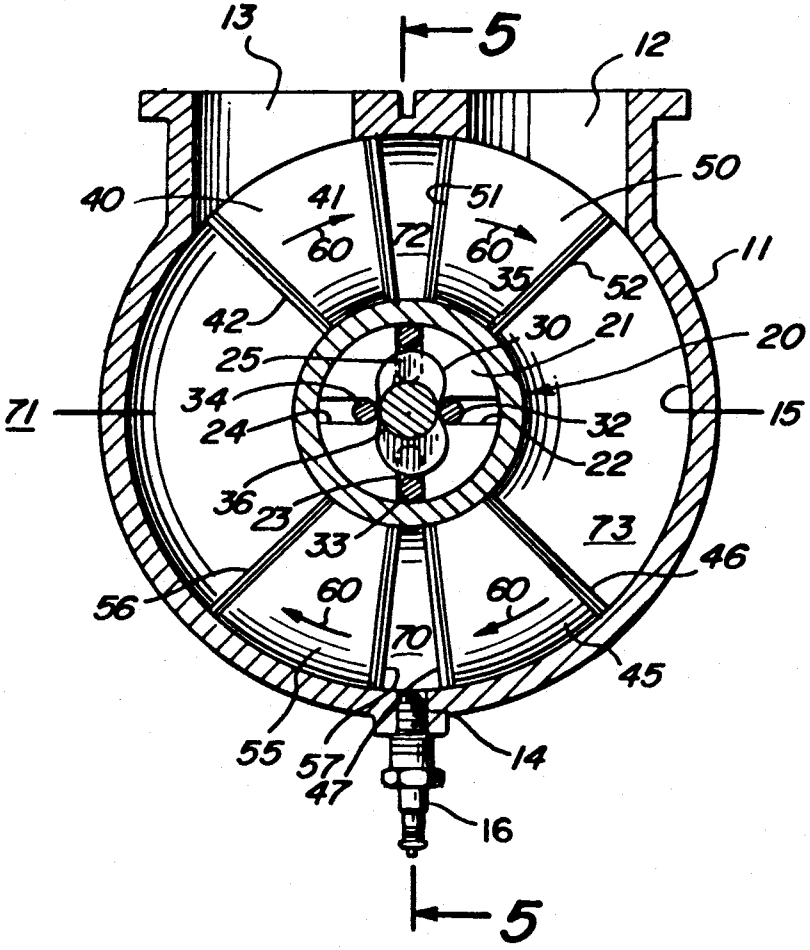
FIG. 1 sets forth a simplified section view of the present invention rotary engine.
Figure 5:
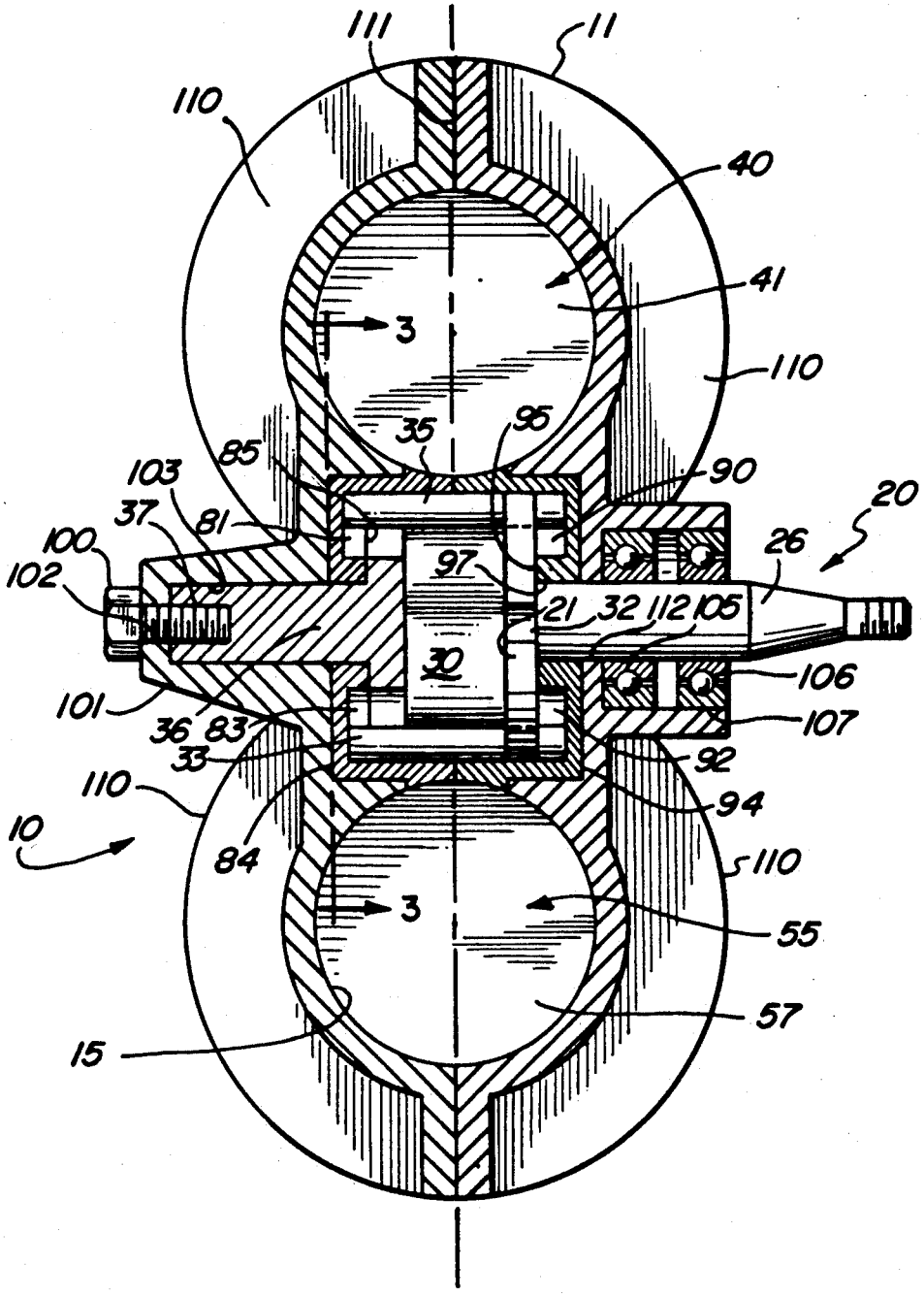
FIG. 5 sets forth a section view of the present invention rotary engine.

FIG. 1 sets forth a section view of the present invention rotary engine taken along section lines 1—1 in FIG. 5 and generally referenced by numeral 10. Rotary engine 10 includes a crank case 11 defining a generally annular circular cross section chamber 15. Crank case 11 further defines an intake port 12, an exhaust port 13 and a spark plug port 14, all of which are in communication with chamber 15. By means set forth below in greater detail, a power coupler 20, constructed in accordance with the present invention, is rotatably supported at the center of chamber 15 of crank case 11. A pair of pistons 40 and 45 having circular cross sections and defining angular segments of a toroid corresponding to chamber 15 are supported on opposite sides of power coupler 20 by means set forth below in greater detail. Piston 40 defines a circular face 41 and a circular face 42 which piston 45 is substantially identical defining a circular face 46 and a circular face 47. A second pair of pistons 50 and 55 generally identical to pistons 40 and 45 are supported on opposite sides of power coupler 20. Piston 50 defines a pair of generally planar faces 51 and 52 while piston 55 defines planar faces 56 and 57. By means set forth below in greater detail, pistons 40 and 45 are mechanically coupled and rotatable about the center of chamber 15 in a mechanical attachment which maintains their one hundred eighty degree opposed relationship. Similarly, pistons 50 and 55 are mechanically coupled in a one hundred eighty degree relationship and are rotatable about the center of chamber 15.

Power coupler 20 includes a generally cylindrical cup-shaped pin guide 21 having defined therein a cylindrical recess and a quartet of radially extending quadrature spaced slots 22, 23, 24 and 25. By means set forth below in greater detail, pin guide 21 is coupled to an output shaft 26 (seen in FIG. 5). A drive cam 30 is supported within chamber 15 by a cam drive shaft 36 in the manner set forth below in FIG. 5. In the embodiment shown in FIG. 1, cam drive shaft 36 is rigidly coupled to crank case 11. A quartet of cylindrical pins 32, 33, 34 and 35 are received within slots 22, 23, 24 and 25 respectively. Pins 32 through 35 are movable within slots 22 through 25 in a radial direction of travel. By means better seen in FIGS. 3 and 4, pins 32 through 35 are coupled within overlapping curved slots within power coupler 20. The structure of the power coupling of pins 32 through 35 is shown and described below in greater detail. However, suffice it to note for purposes of understanding FIGS. 1 and 2, that the coupling between pins 32 through 35, pin guide 21, drive cam 30 and pistons 40, 45, 50 and 55 results in a rotational coupling in which the spacing between the pistons in each piston set is controlled by the radial position of pins 32 through 35 within slots 22 through 25. Thus, in the position shown in FIG. 1, it should be noted that pins 33 and 35 are forced outwardly at a maximum distance by cam 30 while pins 32 and 34 are positioned inwardly against drive cam 30 at their minimum radial distances. Accordingly, the spacing between faces 41 and 51 of pistons 40 and 50 and the spacing between faces 47 and 57 of pistons 45 and 55 is at a minimum while the spacing between faces 46 and 52 and between 56 and 42 are at a maximum. Thus, by means set forth below in greater detail, as pistons 40, 45, 50 and 55 are caused to rotate within chamber 15, the relative spacing between opposed piston faces varies in accordance with the radial position of the corresponding one of pins 32 through 35.

In operation, and with rotary engine 10 in the position shown in FIG. 1, rotary engine 10 is started in accordance with general practice for internal combustion engines by rotating the piston set in the directions indicated by arrows 60 (clockwise). As the piston sets are rotated, the relative motion between pin guide 21 and drive cam 30 cause the above-mentioned radial oscillatory motion of pins 32 through 35.

At this point, it should be understood that the change in spacing between pistons 40, 45, 50 and 55 results in a corresponding change in the confined volume between opposed piston faces within chamber 15. Thus, in the position shown in FIG. 1, confined volume 70 which is captivated between piston faces 47 and 57 and confined volume 42 which is captivated between piston faces 41 and 51 are at a minimum while confined volume 71 between piston faces 42 and 56 and confined volume 73 between piston faces 46 and 52 are at maximum volumes. Thus, as pistons 40, 45, 50 and 55 rotate in the direction of arrows 60, volumes 70 and 72 have become compressed while volumes 71 and 73 are generally relaxed.

Figure 2:
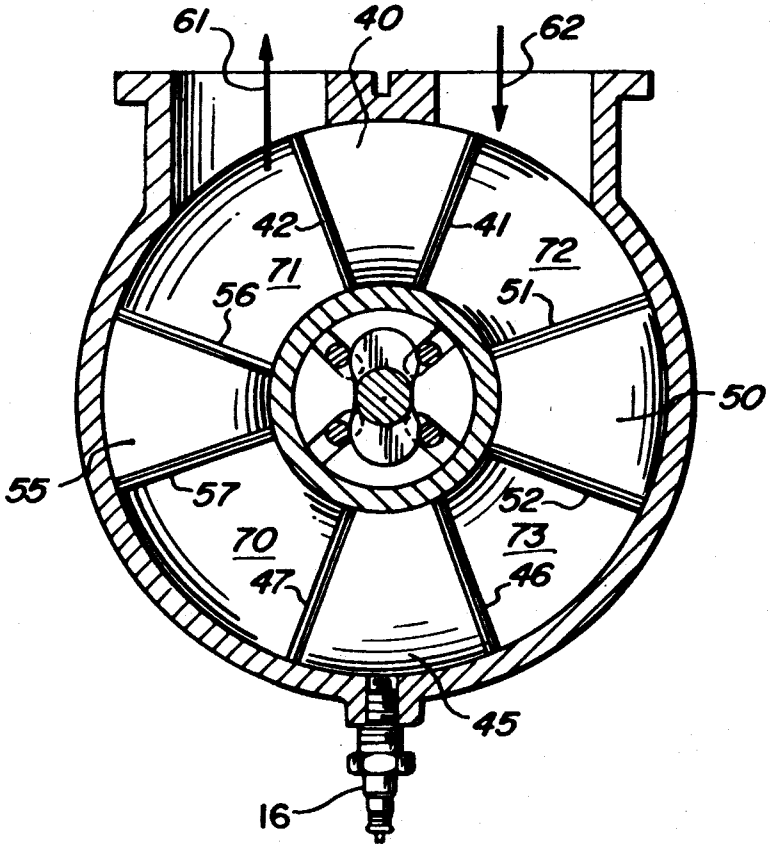
FIG. 2 sets forth the section view of FIG. 1 at an alternate position during the combustion cycle.

With reference now to FIG. 2 in combination with FIG. 1, it should be apparent that FIG. 2 shows the sectional view of FIG. 1 at a point of rotation which is displaced from that shown in FIG. 1 by an angular increment which produces a quadrature relationship between pistons 40, 45, 50 and 55. Correspondingly, it should be noted that pins 32 through 35 are at generally equal radial distances from the center of power coupler 20.

In the position shown in FIG. 1, volume 70 defines a volume of compressed air and fuel mixture while volume 72 defines a volume of spent exhaust gases remaining at the conclusion of the exhaust stroke. Correspondingly, volume 73 defines a fresh volume of fuel air mixture which is not yet compressed while volume 71 defines a burning mixture of fuel and air at its maximum volume. By conventional ignition means, spark plug 15 is energized at the point shown in FIG. 1 causing the compressed fuel air mixture within volume 70 to be ignited and burned rapidly. The burning fuel air mixture within volume 70 exerts an outward force piston faces 47 and 57 which, by means set forth below, drives piston 55 forwardly in the direction in the arrows 60 at a greater velocity than piston 45. As pistons 40, 45, 50 and 55 continue rotating in the direction indicated by arrow 60 following ignition within volume 70, an expansion of volume 70 takes place. FIG. 2 shows the positions of pistons 40, 45, 50 and 55 as volume 70 continues to burn rapidly and expand the relative distances between pistons 45 and 55 and, as a result, pistons 40 and 50. At the point of the combustion cycle shown in FIG. 2, volume 71 which defines a spent fuel mixture is aligned with exhaust port 13 while volume 72 is aligned with intake port 12. At this moment, it should be recognized that as the rotation of pistons 40, 45, 50 and 55 continues, the expansion of volume 70 and 72 continues. Thus, piston 50 is moving ahead of and farther from piston 40 causing volume 72 to be increased which draws fuel air mixture into volume 72 in the direction indicated by arrow 62 through intake port 12. Thus, volume 70 is undergoing a power stroke while volume 72 is undergoing an intake stroke. Concurrently, as the distance between pistons 45 and 55 increases, volumes 71 and 73 are reduced. Because volume 71 is, at the point shown in FIG. 2, aligned with exhaust port 13, the spent fuel gases within volume 71 are driven outwardly by the decreasing distance between piston faces 42 and 56. Concurrently, the decreasing distance between piston faces 46 and 52 compresses the confined volume of fuel air mixture within volume 73.

Thus as pistons 40, 45, 50 and 55 rotate, volumes 70, 71, 72 and 73 are successive carried through the four operational phases of an internal combustion engine of intake compression power and exhaust. During this time, the mechanism of power coupler 20 provides the changes in spacing between pistons 40, 45, 50 and 55 to accomplish this cycle.

Figure 3:
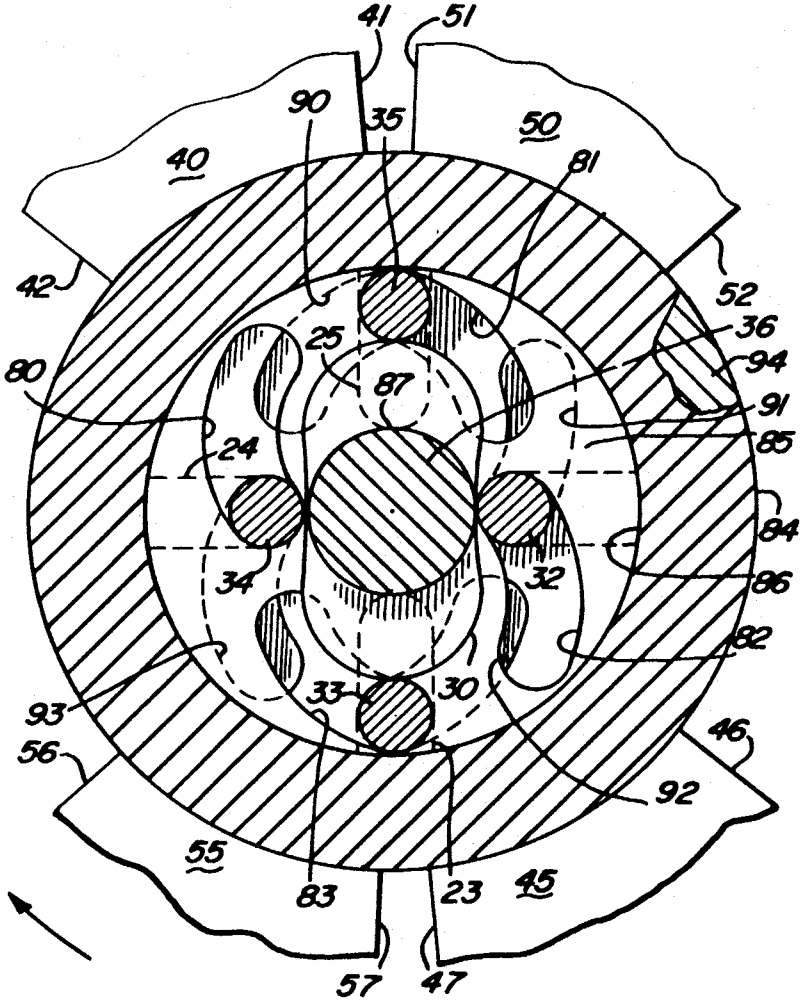
FIG. 3 sets forth a partial section view of the power coupling mechanism of the present invention rotary engine.
Figure 4:
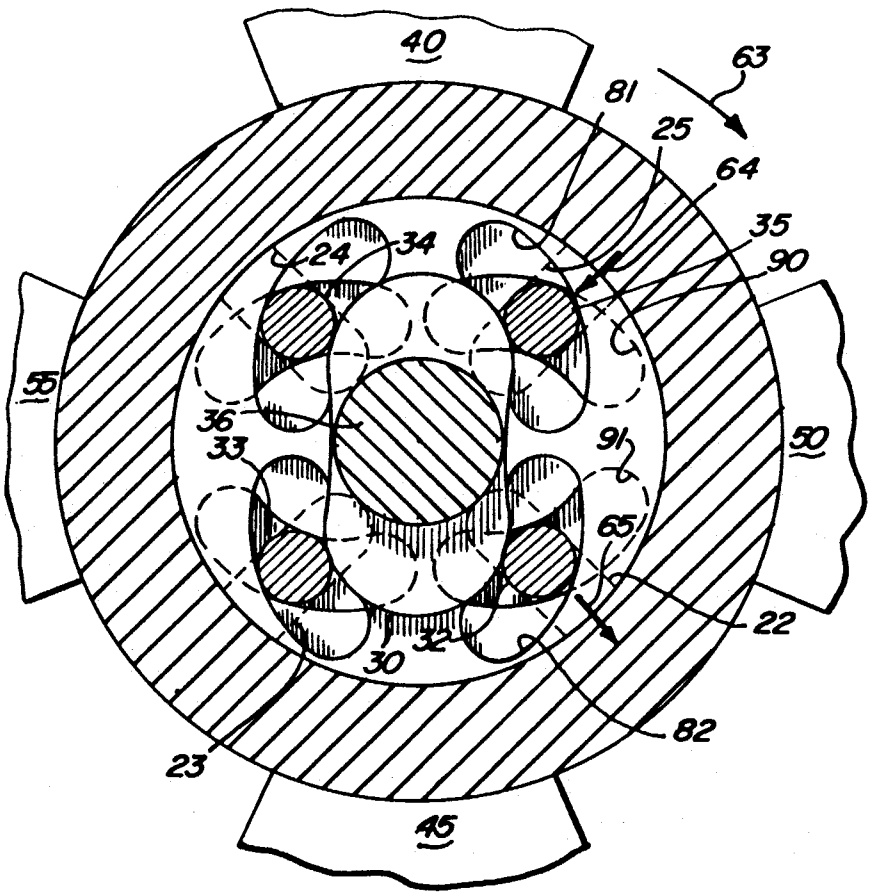
FIG. 4 sets forth a partial section view of the power coupling mechanism of the present invention in an alternate position with respect to that shown in FIG. 3.

FIGS. 3 and 4 set forth section views of power coupler 20 taken along section lines 3-3 at rotational positions corresponding to FIGS. 1 and 2 respectively. Pistons 40 and 45 are supported in their opposed radial positions by a generally cup-shaped piston rotor 84. Rotor 84 defines a cylindrical recess 86 having a planar face 85. Planar face 85 defines a pair of curved slots 80 and 81 aligned with and generally converging toward piston 40 and a similar pair of curved slots 82 and 83 aligned with and generally converging toward piston 45. Planar face 85 further defines a center aperture 87. A second piston rotor 94 (better seen in FIG. 6) supports pistons 50 and 55 in opposed positions. Piston rotor 94 further defines a pair of curved slots 90 and 91 extending toward and converging toward piston 50. Piston rotor 94 further defines a second pair of curved slots 92 and 93 which extend and converge toward piston 55. Piston rotor 94 further defines a center aperture 95 (seen in FIG. 6). Pin guide 21 (as is better seen in FIG. 5) is positioned between planar face 85 of rotor 84 and planar face 95 of rotor 94. Drive cam 30 is positioned within the cylindrical portion of the cup-shape pin guide 21. Cam shaft 36 extends through aperture 87 in planar face 85 and is secured to crank case 11 as shown in FIG. 5. Also seen in FIG. 3 are slots 22, 23, 24 and 25 shown in dashed line representation. In accordance with the above descriptions of power coupler 20, pin 32 extends through slots 82 and 91 of rotors 84 and 94 respectively and is received within slot 22 of pin guide 21. Similarly, pin 33 is received within slot 83 and 92 of piston rotors 84 and 94 respectively and within slot 23 of pin guide 21. Pin 34 extends through slot 80 and 93 of piston rotors 84 and 94 respectively and is also received within slot 24 of pin guide 21. Finally, pin 35 extends through slots 81 and 90 in piston rotors 84 and 94 respectively and is received within slot 25 of pin guide 21.

In operation, pins 32 through 35 are positioned by drive cam 30 such that pins 33 and 35 are forced outwardly to their maximum radial distance while pins 32 and 34 are positioned inwardly at their minimal radial distances. As a result, pistons 40 and 50 and pistons 45 and 55 are positioned in close proximity corresponding to the relative positions shown in FIG. 1.

FIG. 4 sets forth the section view of FIG. 3 in which pistons 40, 45, 50 and 55 have rotated in the direction indicated by arrow 63 to the portion of the above-described cycle in which the pistons are generally in quadrature. As can be seen, the fixed position of drive cam 30 and the relative motions of pistons 40, 45, 50 and 55 have produced this quadrature effect due to the cooperation of pins 32 through 35 and their respective curved slots within rotors 84 and 94. For example, comparison of the position of pin 35 within slot 81 and 90, shows that the relative motions of pistons 40 and 50 and the surface of drive cam 30 have cooperated therewith to move pin 35 inwardly in the direction indicated by arrow 64. Conversely, for example, pin 32 has been moved outwardly in the direction indicated by arrow 65 due to the force applied by slots 82 and 91 together with drive cam 30.

Thus, as can be seen, the coupling between pins 32 through 35 and their respective curved slots within piston rotors 84 and 94 together with the corresponding slots within pin guide 21 cooperate to form a bidirectional power coupling between piston rotors 84 and 94 and output shaft 26 and drive cam shaft 36. The power coupling is bilateral in that during power stroke portions of the combustion cycle described above, the force between separating pistons is coupled to drive cam 30 and pin guide 21. During other portions of the combustion cycle, momentum of rotors 84 and 94 and pistons 40, 45, 50 and 55 and associated rotating parts couple energy back to pins 32 through 35 and cause corresponding motions between pistons 40, 45, 50 and 55.

It will be apparent to those skilled in the art that the power coupling mechanism of the present invention may accommodate virtually any engine in which angularly moving pistons have a varying spacing therebetween for a variable volume displacement. Thus, the present invention should be understood to apply to other piston shapes and configurations. For example, it should be apparent that two pistons such as pistons 40 and 45 may be formed within a rotating drum within which pistons 50 and 55 move.

It should also be noted that the use of a fixed attachment of either piston rotor 94 or 84 to crank case 11 may be used to produce oscillatory motion, rather than the rotational motion described above. Such a variation is well-suited to pumps and other similar engines. It will be understood, of course, that appropriate valve structure can be used to accommodate such pump-type engines or the like using conventional one-way valves.

In the embodiment shown in FIGS. 1 through 5, drive cam shaft 36 is secured to crank case 11 in a fixed attachment. The secure attachment of cam shaft 36 maintains drive cam 30 at a fixed position. As a result, the power coupled from pistons 40, 45, 50 and 55 to power coupler 20 are applied to output shaft 26 causing rotation thereof. It will be apparent to those skilled in the art, however, that an alternate configuration may be utilized without departing from the spirit and scope of the present invention. For example, output shaft 36 may be fixed to crank case 11 and output power coupled from rotary engine 10 via drive cam shaft 36 in the form of rotational motion which results from the oscillatory motions of both piston rotors 94 and 84. It will be understood that appropriate valve structure can be used to accommodate such pump-type engines. In addition, it will be apparent to those skilled in the art that the contour of cam 30 may be selected to suit the number of combustion chambers and pistons. It will be still further apparent to those skilled in the art that multiple sets of pistons and combustion chambers may be coupled using cascading combinations of power coupler 20. Similary, a plurality of piston rotors each supporting piston sets within a common combustion chamber may be intercoupled by two or more power couplers of the type shown in FIGS. 1 through 6. It will also be apparent to those skilled in the art that while the embodiment shown in FIGS. 1 through 5 sets forth a rotary internal combustion engine, the present invention may be utilized equally as well in other engines such as rotary compressors or pumps. In such case, output shaft 26 or drive cam shaft 36 is coupled to a source of rotational power while drive cam shaft 36 or output shaft 25 is maintained fixed to crank case 11. Thus, in the compressor or pump-type embodiments of the present invention, the above-mentioned reversal of roles may also be carried forth in which output shaft 26 is maintained fixed to crank case 11 while drive cam shaft 36 is coupled to a source of rotational power. It should be understood therefore that the term "engine" as use in the appended claims embraces both power producing and power consuming engines.

FIG. 5 sets forth a section view of the present invention rotary engine taken along section lines 5–5 in FIG. 1. For purposes of illustration, spark plug 15 and intake and exhaust port 12 and 13 have been omitted. Crank case 11 is shown formed in two half portions secured together in a sealing attachment along a parting line 111. Crank case 11 defines an annular chamber 15 having a plurality of cooling fins 110 extending outwardly therefrom. Crank case 11 further defines a center aperture 102 and a passage 103 supporting cam shaft 36. Crank case 11 further defines a bearing housing 107 supporting a pair of bearings 105 and 106. Within crank case 11, a piston rotor 84 defines a center aperture 87 and a plurality of curved slots including slots 81 and 83. Piston rotor 84 supports a pair of pistons 40 and 45 (the latter seen in FIG. 2). A drive cam shaft 36 defines a cylindrical portion extending through aperture 87 and supported by passage 103 in crank case 11. A drive cam 30 is supported within piston rotor 84 by drive cam shaft 36. A bolt 100 is received within threaded aperture 37 of drive cam shaft 36 to secure cam 30 with respect to crank case 11.

A piston rotor 94 supports a pair of pistons 50 and 55 (the former seen in FIG. 1). Piston rotor 94 defines a center aperture 97 and a plurality of curved slots (seen in FIG. 3) such as slots 90 and 92. A pin guide 21 defines a quartet of radially extending quadrature slots and an output shaft 26 extends through aperture 112 in crank case 11 and is joined to pin guide 21. Bearings 105 and 106 support output shaft 26 in a rotational support. A plurality of drive pins 32 through 35 of which pins 32, 33 and 35 are visible in FIG. 5, are receive within the curved slots of piston rotors 84 and 94 in the manner set forth above. Drive pins 32 through 35 are also received within slots 22 through 25 as set forth above in FIG. 1.

In operation, the above-described combustion cycle produces rotational power which is coupled from pistons 40, 45, 50 and 55 to piston rotors 84 and 94. The cooperation of pins 32 through 35 within the curved slots of piston rotors 84 and 94 together with drive cam 30 and pin guide 21 couple the power produced to output shaft 26. As is described above, it will be apparent from examination of FIG. 5 that a reverse relationship between output shaft 26 and drive cam shaft 36 may be utilized in which output shaft 26 is maintained fixed to crank case 11 in which case rotational power is applied to and available at drive cam shaft 36.

Figure 6:
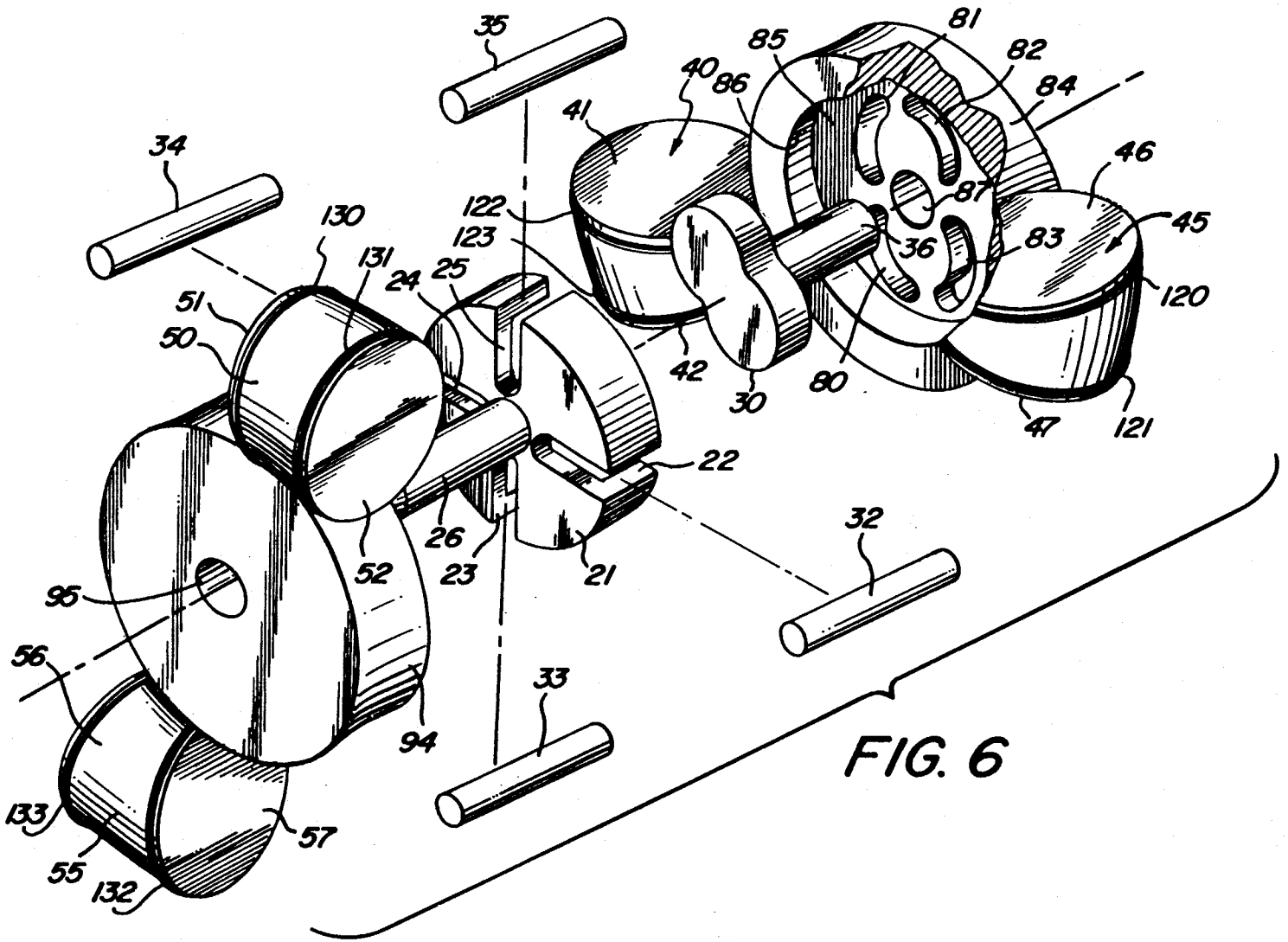
FIG. 6 sets forth a perspective assembly view of the power coupling mechanism of the present invention rotary engine.

FIG. 6 sets forth an exploded assembly view of the present invention power coupling. A piston rotor 84 defines a generally cylindrical cup-like member having a center aperture 87 and a plurality of curved slots 80 through 83. Piston rotor 84 further defines a center recess 86 defining a planar face 85. A pair of toroidal section shaped pistons 40 and 45 are supported in an offset alignment with piston rotor 84. Piston 40 defines a pair of angled planar faces 41 and 42 while piston 45 defines a pair of angled planar faces 46 and 47. A pair of piston rings 122 and 123 are received upon piston 40 while a pair of piston rings 120 and 121 are received upon piston 45. A drive cam 30 is supported by a drive cam shaft 36 by the extension of cam shaft 36 through aperture 87 of piston rotor 84.

A second piston rotor 94, having the same construction as piston rotor 84, defines a center aperture 95 and a plurality of curved slots 90 through 93 (seen in FIG. 3). A pair of toroidal section shaped pistons 50 and 55 are secured to piston rotor 94 in an offset configuration better seen in FIG. 5. Piston 50 defines a pair of planar angled surfaces 51 and 52 and supports a pair of piston rings 130 and 131. Piston 55 defines a toroidal section member having a pair of inclined planar faces 56 and 57. Piston 55 supports a pair of piston rings 132 and 133.

A pin guide 21 defines a cup-shaped member having a quartet of quadrature radially extending slots 22 through 25 defined therein. A cylindrical output shaft 36 is joined to pin guide 21. Pin guide 21 is received within the interior of piston rotor 84 and output shaft 36 extends through aperture 95 therein. Pins 32 through 35 are received within slots 22 through 25 respectively of pin guide 21 and extend into the curved slots in piston rotors 84 and 94 in the manner described above to provide the present invention coupling for pistons 40, 45, 50 and 55.

What has been shown is a rotary engine and power coupling therefor which facilitates the generation and coupling of substantial power and which provides flexibility to produce the desired piston motion while providing sufficient strength to couple substantial amounts of power not found in prior art structures.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. Rotary engine comprising:

a housing defining an annular cavity, said annular cavity defining a predetermined cross-section;

a first piston rotor having a first rotating member defining a first plurality of curved slots and a first plurality of outwardly extending pistons having a cross-section corresponding to said predetermined cross section;

a second piston rotor having a second rotating member defining a second plurality of curved slots and a second plurality of outwardly extending pistons having cross-section corresponding to said predetermined cross-section;

a pin guide defining a plurality of radially extending slots;

a first shaft coupled to said pin guide;

a drive cam defining a cam surface;

a second shaft coupled to said cam; and a plurality of pins each partially received within one of said curved slots in each of said first and second piston rotors and one of said slots in said pin guide and each contacting said cam surface.

2. A rotory engine as set forth in claim 1 wherein said first and second rotating members are disposed on opposite sides of said drive cam and said pin guide and wherein said pins extend between said first and second rotating members.

3. A rotary engine as set forth in claim 2 wherein said first and second pluralities of curved slots are each arranged in pairs which generally converge with increased radial distance from the center of said rotating members.

4. A rotary engine as set forth in claim 3 wherein said first and second rotating members define generally cylindrical shapes.

5. A rotary engine as set forth in claim 4 wherein said first and second rotating members define inwardly facing center recesses receiving said pin guide and said drive cam therein.

6. A rotary engine as set forth in claim 5 wherein said first and second pluralities of pistons each define pairs of pistons oppositely supported on said first and second rotating members.

7. A rotary engine as set forth in claim 6 wherein said annular cavity is toroidal and wherein said cross-sections of said annular cavity and said pistons are circular.

8. A rotary engine as set forth in claim 7 wherein said pistons each define toroidal segments.

9. A rotary engine as set forth in claim 6 wherein rotating members each define centers of rotation and wherein said pairs of curved slots are symmetrically disposed on each side of an axis extending through said centers of rotations.

10. A rotary engine as set forth in claim 1 wherein said pins each define opposed ends and wherein slots in said first and second pluralities of slots each define curved slot recesses having an open side for receiving an opposed end of one of said pins and a closed side for confining said opposed end of said one of said pins.

11. A rotory engine as set forth in claim 10 wherein said first and second rotating members are disposed on opposite sides of said drive cam and said pin guide and wherein said pins extend between said first and second rotating members.

12. A rotary engine as set forth in claim 11 wherein said first and second pluralities of curved slots are each arranged in pairs which generally converge with increased radial distance from the center of said rotating members.

13. A rotary engine as set forth in claim 12 wherein said first and second rotating members define generally cylindrical shapes.

14. A rotary engine as set forth in claim 13 wherein said first and second rotating members define inwardly facing center recesses receiving said pin guide and said drive cam therein.

15. A rotary engine as set forth in claim 14 wherein said first and second pluralities of pistons each define pairs of pistons oppositely supported on said first and second rotating members.

16. A rotary engine as set forth in claim 15 wherein said annular cavity is toroidal and wherein said cross-sections of said annular cavity and said pistons are circular.

17. A rotary engine as set forth in claim 16 wherein said pistons each define toroidal segments.

18. A rotary engine as set forth in claim 15 wherein rotating members each define centers of rotation and wherein said pairs of curved slots are symmetrically disposed on each side of an axis extending through said centers of rotations.

19. A rotary engine comprising:

a housing defining a curved chamber;

means supporting a plurality of pistons within said chamber such that the spacing between adjacent pistons is variable to form a variable combine volume therebetween;

power coupling means including a first movable member coupled to at least one of said plurality of pistons, a second movable member coupled to at least one other piston in said plurality of pistons adjacent said one piston, said first and second members defining first and second curved slots, a pin guide defining at least one radially extending slot, a drive cam having a cam surface, and at least one pin extending coupling said first and second curved slots, said radially extending slot and contacting said cam surface; and first and second power shafts coupled to said drive cam and said pin guide.

20. A rotary engine as set forth in claim 19 wherein said curved chamber is annular and wherein said cam surface is shaped to permit variable rotation of said first and second movable members.

21. A rotary engine as set forth in claim 19 wherein said pin guide shaft is fixed to said housing and output power is coupled via said drive cam shaft to cause oscillatory motions of said first and second movable members.

22. A rotary engine as set forth in claim 19 wherein said one movable member is fixed to said housing and output power is coupled via said drive cam shaft to cause oscillatory motion of said second movable member.

23. A drive coupling for use in a rotary engine in which a pair of pistons rotate and confine a variable volume therebetween, said drive coupling comprising:

a first piston rotor having a first rotating member defining a first plurality of curved slots and a first plurality of outwardly extending pistons having a cross-section corresponding to said predetermined cross section;

a second piston rotor having a second rotating member defining a second plurality of curved slots and a second plurality of outwardly extending pistons having cross-section corresponding to said predetermined cross-section;

a pin guide defining a plurality of radially extending slots;

a first shaft coupled to said pin guide;

a drive cam defining a cam surface;

a second shaft coupled to said cam; and a plurality of pins each partially received within one of said curved slots in each of said first and second piston rotors and one of said slots in said pin guide and each contacting said cam surface.

* * * * *